US008123917B2

(12) United States Patent
Dufresne

(10) Patent No.: US 8,123,917 B2
(45) Date of Patent: Feb. 28, 2012

(54) CONTACT BAR FOR CAPPING BOARD

(75) Inventor: Robert P Dufresne, St-Bruno (CA)

(73) Assignee: Pultrusion Technique Inc., St-Bruno (CA)

( * ) Notice: Subject to any disclaimer, the term of this patent is extended or adjusted under 35 U.S.C. 154(b) by 294 days.

(21) Appl. No.: 12/528,435

(22) PCT Filed: Feb. 21, 2008

(86) PCT No.: PCT/CA2008/000339

§ 371 (c)(1),
(2), (4) Date: Oct. 28, 2009

(87) PCT Pub. No.: WO2008/101345

PCT Pub. Date: Aug. 28, 2008

(65) Prior Publication Data

US 2011/0132753 A1 Jun. 9, 2011

(30) Foreign Application Priority Data

Feb. 22, 2007 (CA) ..... 2579459

(51) Int. Cl.

| | |
|---|---|
| ***C25B 9/02*** | (2006.01) |
| ***C25B 9/04*** | (2006.01) |
| ***C25D 17/06*** | (2006.01) |
| ***C25D 17/08*** | (2006.01) |

(52) U.S. Cl. ..... 204/297.01; 204/297.06; 204/286.01; 204/279

(58) Field of Classification Search ..... 204/279, 204/286.1, 297.01, 297.06
See application file for complete search history.

(56) References Cited

U.S. PATENT DOCUMENTS 3,697,404 A * 10/1972 Paige ..... 204/267
4,035,280 A 7/1977 Deane et al.
(Continued)

FOREIGN PATENT DOCUMENTS

CA 1201681 A 3/1986
(Continued)

*Primary Examiner* — Bruce Bell
(74) *Attorney, Agent, or Firm* — Baker & Hostetler LLP

(57) ABSTRACT

Disclosed is a contact bar for use on a capping board of a given length in order to electrically connect a plurality of anodes and cathodes extending in spaced apart, alternate positions in adjacent electrolytic cells all along the capping board. The contact bar extends over the length of the capping board and is of a given average cross-section. This contact bar comprises a central core that is made of an insulating material and extends all over its length. This contact bar also comprises a plurality of contact pieces that are made of an electrically conductive material and are positioned in spaced apart positions all along the core, each of the pieces defining a segment on which only a short number of the anodes and cathodes are connected. Due to such a division of the contact bar into segments formed by the contact pieces that are no more an electrical contact with each other thanks to the core made of insulating material, any short circuit that occurs by accident is no more "transferred" to all the electrodes of the cells. It is actually transmitted only to the few electrodes in contact with the segment(s) to which is connected the electrode that may cause the trouble.

9 Claims, 5 Drawing Sheets

U.S. PATENT DOCUMENTS

| | | | | |
|---|---|---|---|---|
| 4,213,842 | A | 7/1980 | Dufresne | |
| 5,645,701 | A * | 7/1997 | Dufresne et al. | 204/297.01 |
| 6,342,136 | B1 | 1/2002 | Virtanen et al. | |
| 7,204,919 | B2 * | 4/2007 | Dufresne | 204/279 |
| 7,223,324 | B2 * | 5/2007 | Dufresne | 204/279 |
| 7,597,786 | B2 * | 10/2009 | Kivisto et al. | 204/286.1 |
| 7,854,825 | B2 * | 12/2010 | Ebert | 204/297.01 |
| 2005/0121319 | A1 | 6/2005 | Dufresne | |

FOREIGN PATENT DOCUMENTS

| | | | |
|---|---|---|---|
| CA | 2171412 | A | 9/1997 |
| CA | 2451950 | A | 6/2005 |

* cited by examiner

CONTACT BAR FOR CAPPING BOARD

CROSS-REFERENCE TO RELATED APPLICATIONS

This application is a National Stage of International patent application PCT/CA2008/000339, filed on Feb. 21, 2008, which claims priority to foreign patent application CA 2,579,459, filed on Feb. 22, 2007, the disclosures of which are incorporated herein by reference in their entirety.

BACKGROUND OF THE INVENTION a) Field of the Invention

The present invention relates to a contact bar for use on a capping board, also called "bus bar insulator", of a given length in order to electrically connect a plurality of anodes and cathodes extending in spaced apart alternate positions in adjacent electrolytic cells all along the capping board.

b) Brief Description of the Prior Art

In the hydrometallurgical industry, it is of common practice to refine metal by electrolysis in electrolytic cells especially designed for this purpose. The metals to be refined are usually conventional metals like copper, zinc, nickel or cadmium, or precious metals like silver, platinum or gold, and others.

It is also of common practice to use metal plates as anodes or cathodes or both. These metal plates weight several hundred pounds. Usually, the metal to be refined, or the metal used to carry the electric current, is in the form of plates of a given thickness, which are provided at their upper end with two laterally extending projections. Such projections facilitate gripping, handling and hanging of the plates on lateral sidewalls of the cells. These projections serve also to electrically contact or insulate the electrode.

In use, the plates which, as aforesaid, can each weight several hundred pounds, are immersed into the cells in parallel relationship and are used as anodes, cathodes or both, depending on the affinity of the metal being refined.

In order to have the electrodes positioned at the exact place, it is of common practice to place a member called "capping board" or "bus bar insulator" onto the top surface of each lateral sidewall of the cells. These capping boards are used to position the plates with respect to each other. They are also used as electric insulators between adjacent cells and/or each electrodes and/or the ground.

In practice, the capping boards are used not only as supports to position the electrodes, but also as supports to avoid damage to the masonry or concrete forming the lateral side walls of the cells during the insertion and removal of the heaving electrodes.

As examples of such capping boards and the way they can be manufactured, reference can be made to U.S. Pat. No. 4,213,842 issued on Jul. 22, 1980 and Canadian patent No. 1,102,737 issued on Jun. 9, 1981 both in the name of Jean L. DUFRESNE. Reference can also be made to the U.S. Pat. No. 5,645,701 issued on Jul. 8, 1997 and Canadian laid-open patent application No. 2,171,412 filed on Mar. 8, 1996 both in the names of Jean L. DUFRESNE and the present inventor, namely, Robert P. DUFRESNE. Reference can further be made to U.S. laid-open patent application No. US 2005/012139 A1 published on Jun. 9, 2005 and to its Canadian counterpart in the name of the present inventor.

As other examples of such capping boards, reference can also be made to U.S. Pat. No. 3,697,404 issued on Oct. 10, 1972 to Peter M. PAIGE and to U.S. Pat. No. 6,342,136 issued on Jan. 29, 2002 to OUTOKUMPU OYJ.

As aforesaid, the above mentioned insulating capping boards are used to hold the electrodes at very precise positions. They are also used in combination with electrically conductive contact bars whose purpose is to allow electrical connection between the ends of the anodes and cathodes located in the adjacent cells. Thus, the combined use of capping boards and contact bars have the particularity of allowing insulation and distribution of electric current at the same time.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be insulated. Thus, the capping board per se plays the role of an insulator and has, for this purpose, to be made of material that is insulating.

So far, it has been of common practice to use contact bars of usually triangular cross-section, that extends over the full length of the corresponding capping board in order to connect altogether all the anodes of one cell to all the cathodes of the adjacent cell.

The problem with such contact bars is that, in the case that a short circuit would occur, such would "affect" all the electrodes which are connected altogether. Such causes the temperature of some of the metal plates forming the anodes and cathodes and the contact bar to increase and such an increase may be transmitted to the insulating capping-boards, which may then be subject to deformation. Such deformation is unacceptable since it may generate other short circuits that may propagate from one cell to another cell and which may result in the production of a refined metal with major impurity and defects.

SUMMARY OF THE INVENTION

It has now been discovered that the above mentioned problem encountered with the conventional contact bars in the case of short circuits, may be solved if the contact bars are "divided" into a plurality of segments on which only a short number of the anodes and cathodes are connected.

Due to such a division of the contact bars into segments, any short circuit that occurs by accident is using only the electric current of the segment instead of the electric current of the whole cell. It is actually transmitted only to the few electrodes in contact with the segment(s) to which is connected the electrode that is at the origin of the trouble.

Thus, the invention is directed to an improved contact bar for use on a capping board of a given length in order to electrically connect a plurality of anodes and cathodes extending in spaced apart alternate positions in adjacent electrolytic cells all along said capping board or bus bar insulator, the contact bar extending over the length of the capping board and being of a given average cross-section.

The improvement lies in that the contact bar comprises:

a central core that is made of an insulating material and extends all over the length of the contact bar, and a plurality of contact pieces that are made of an electrically conductive material and are positioned in spaced apart positions all along the core, each of the pieces defining a segment on which only a short number of the anodes and cathodes are connected.

Due to such a division of the contact bar into segments formed by the contact pieces that are no more an electrical contact with each other thanks to the core made of insulating material, any short circuit that occurs by accident is no more "transferred" to all the electrodes of the cells. It is actually transmitted only to the few electrodes in contact with the segment(s) to which is connected the electrode that may cause the trouble.

Preferably, the core consists of a pultruded rod obtained by pultrusion of fibers.

Preferably also, the core comprises a metal rod that is completely embedded therein and extends all over the length of the pultruded core.

In practice, each segment of the improved contact bar according to the invention may be sized to allow connection of only two anodes located in one of the adjacent cells to only two cathodes located in another one of the adjacent cells. Alternatively, each segment may be sized to allow connection of three, four or more adjacent anodes located in one of the adjacent cells to three, four or more adjacent cathodes located in another one of adjacent cells.

In all cases, it is important that all the electrodes of one cell may not be in direct contact with no gap or resistance in between, with all the electrodes of the adjacent cell.

The invention and its advantages will be better understood upon reading the following non-restrictive description of a preferred embodiment thereof, made with reference to the accompanying drawings.

DETAILED DESCRIPTION OF THE INVENTION

As aforesaid, FIGS. 1 to 4 show one of the capping boards disclosed in Applicant's U.S. patent application filed on Dec. 3, 2003, namely the one shown in FIGS. 8 to 16 of this application.

Figure 4:
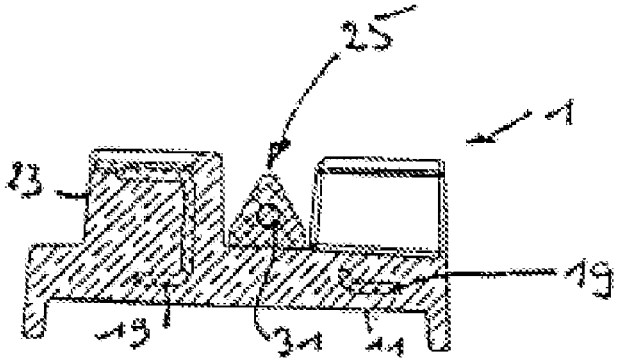
Figure 5:
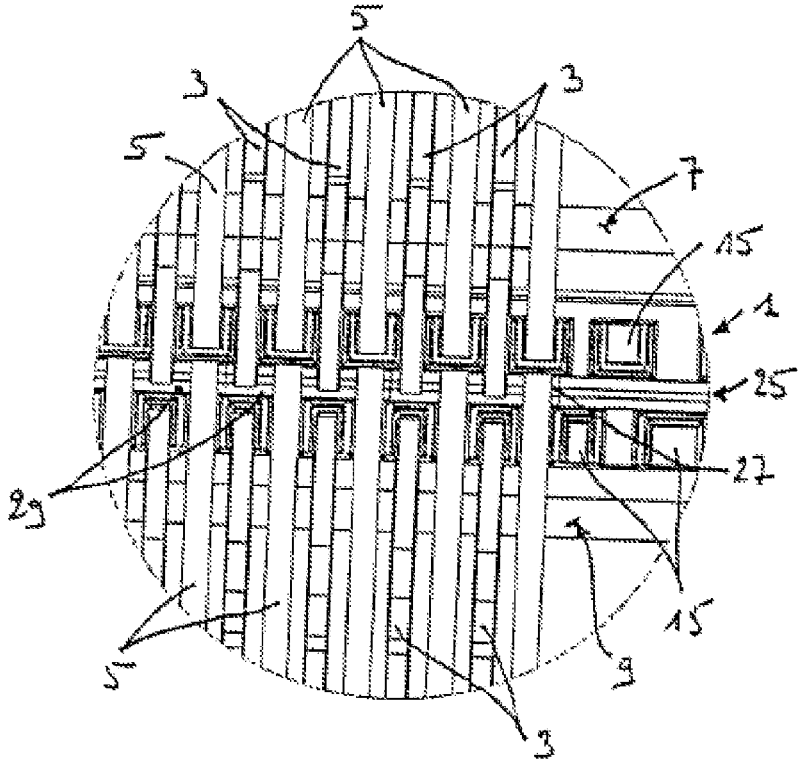
FIG. 5 is a top plan view of a portion of the capping board and contact bar shown in FIGS. 1 to 4, illustrating the way they support the ends of the is anodes and cathodes located in adjacent electrolytic cells.
Figure 6:
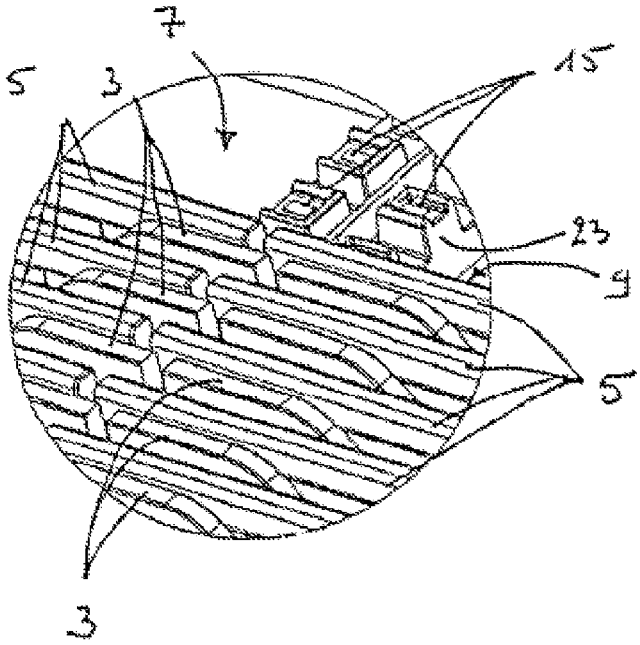
FIG. 6 is a perspective view of the capping board, contact bar and electrodes shown in FIG. 5.
Figure 7:
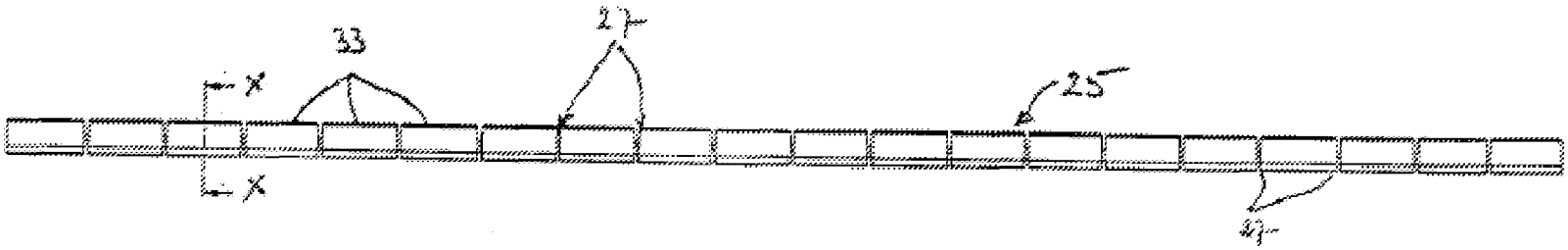
FIG. 7 is a side elevational view of the contact bar according to the first embodiment of the invention, as shown in the previous Figures.
Figure 8:
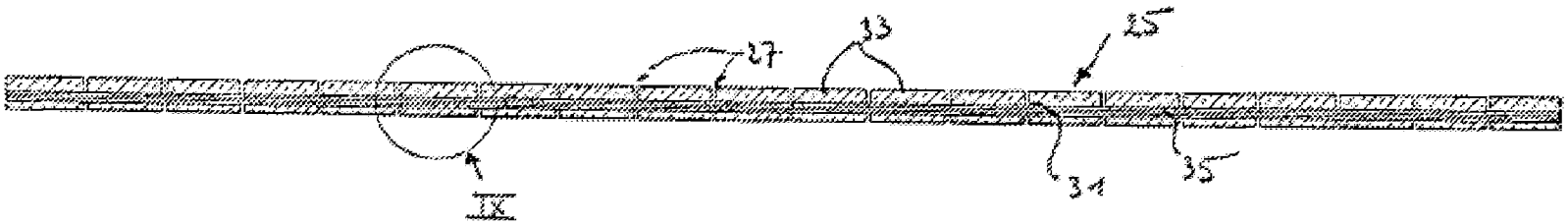
FIG. 8 is a cross-sectional view of the contact bar shown in FIG. 7.
Figure 9:
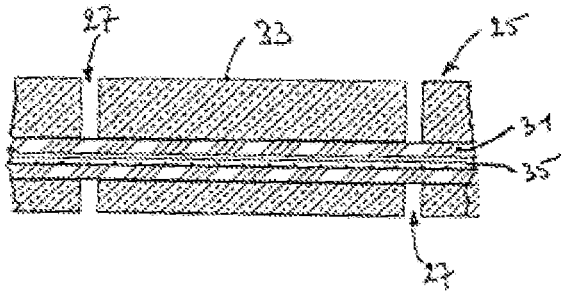
FIG. 9 is an enlarged cross-sectional view of part IX of the contact bar shown in FIG. 8.

This capping board 1 is intended to be used to support the hanging legs of anodes 3 and cathodes 5 mounted within adjacent electrolytic cells 7 and 9 (see FIGS. 5 and 6). It basically comprises a main body with a bottom surface 11 shaped to fit onto upper edges of two adjacent cells. It also comprises a top surface in which individual seats 15 are made. As is better shown in FIGS. 3, 4 and 6, the seats 15 are in the form of recesses made on top of spaced-part blocks 23 integral to and upwardly projecting from the top surface of the main body, each of the recesses forming a laterally opening compartment.

More specifically, the capping board 1 comprises a first set of spaced apart blocks 23 extending in line all over its length on one side of the main body, and a second set of spaced apart blocks 23 extending also in line all over its length at a given lateral distance from the first set of blocks. The two sets of blocks 23 form two rows that together define a central part in which a contact bar 25 may be positioned.

As is shown the blocks 23 of the first set are in alternate position relative to those of the second one, whereby an anode 3 or cathode 5 having one hanging leg held within a recess made on top of one of the blocks on one side of a cell may have its opposite hanging leg that extends between to adjacent blocks of another capping board located on the other side of the cell and thus bears onto the contact bar 25 located in the central path of the other capping board.

Figure 1:
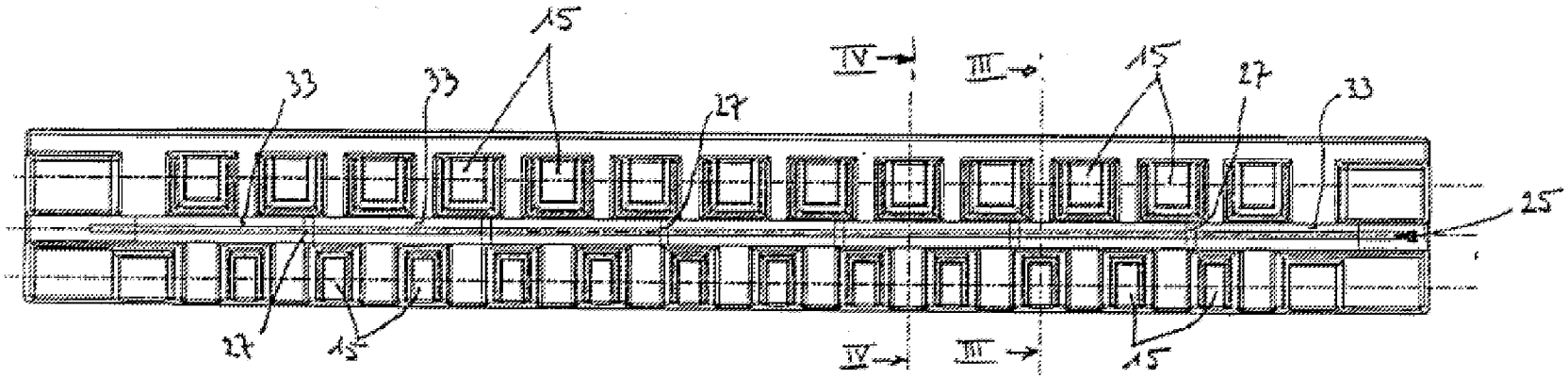
FIG. 1 is a top plan view of one of the capping boards disclosed the above mentioned U.S. patent application filed on Dec. 3, 2003, which capping board is provided with a central path in which a contact bar according to an embodiment of the invention is positioned.
Figure 2:
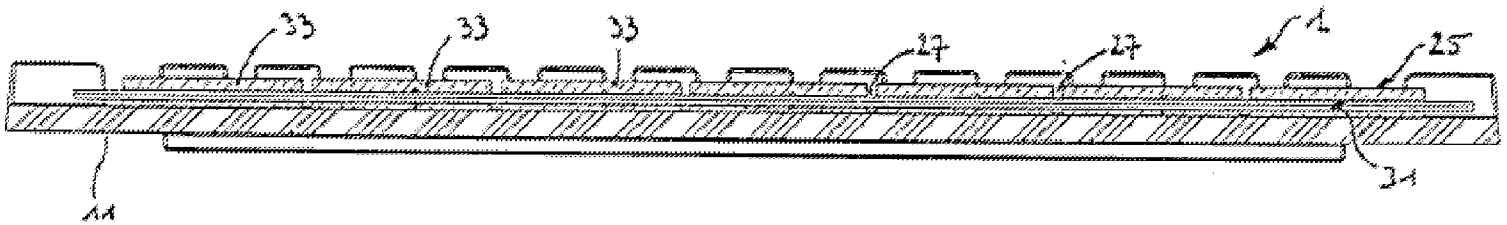
FIG. 2 is a side elevational cross-section view taken along lines II-II of the capping board and contact bar shown in FIG. 1.
Figure 3:
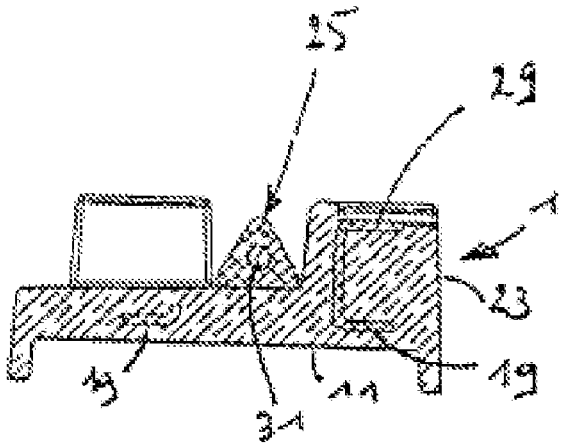
FIGS. 3 and 4 are cross-sectional views taken along lines and IV-IV of the capping board and contact bar shown in FIG. 1.

As shown in FIGS. 3 and 4, two sheets 19 of conductive material, preferably made of copper, are embedded into the main body of the capping board. Each sheet 19 has a base from which integrally project a plurality of L-shaped teeth 29. Each of the teeth 29 extend into one of the blocks 23 in such a manner as to have part of it that extends externally into the recess 15 forming the compartment on top of the insulating block.

The capping boards 1 is preferably made from a plastic resin selected from the group consisting of polytetrafluoroethylene, acid resistant polyester, polyvinyl ester, epoxy, polyurethane, thermoset urethane, bisphenol-epoxy A-F fumarate polyester, acrylic and methacrylic terephtalate polyester and phenolic resins, and blends of such resins, to which from 3 to 30% of glass fibres, from 2 to 10% of silica sand, from 1 to 30% mica, and from 2 to 40% of silica rock in the form of particles, have been added. Use can also be optionally made of 2 to 40% filler such as clay, talc, calcium carbonate and magnesium oxide and from 0.1 to 5% of fumed silica.

In practice, use is preferably made of an acid-resistant polyester resin because this resin is less expensive in addition of being easy to handle and providing good material stability.

Advantageously, the capping board 1 may also comprise at least one embedded pultruded bar. Each of those pultruded bars may be obtained by pultrusion of fibres selected from the group consisting of glass fibres, cizal fibres or resin fibres with a resin selected from the group consisting of polyester, vinyl ester, epoxy, polyurethane, thermoset urethane, bisphenol-expoxy A-F fumarate polyester series, acrylic and methacrylic, terephatalate polyester, urethanes and phenolic resins and their mixtures, said at least one pultruded bar being further coated with a surface layer of a resin bonding agent.

Preferably, more than one pultruded bars are embedded into the capping board, their bars being spaced-apart and arranged in a parallel relationship over the full length of the capping board.

As aforesaid, the present invention lies in the structure of the contact bar 25 that is used in combination with the above capping board 1. In this connection, it may be understood the contact bar 25 according to the invention could also be used with other conventional capping boards, like those disclosed in the various patents mentioned hereinabove in the "Background of the invention".

In accordance with the invention, the contact bar 25 extends all over the length of the capping board 1 for the purpose of allowing connection of the anodes 3 located in one electrolysis cell to the cathodes 5 located in the adjacent electrolysis cell, via their respective hanging legs that stay directly on it.

As better shown in FIGS. 7 to 12, the contact bar 25 is preferably of triangular cross-section. However, it could be of a different cross-section. By way of example, it could be of circular cross-section, as is the contact bar disclosed in U.S. Pat. No. 4,035,280 of 1977 in the name of Richard DEANE et al.

The contact bar 25 according to the invention distinguishes from the contact bars presently in use in the industry, in that it comprises a central core 31 that is made of an insulating material and extends all over its length. It also comprises a plurality of contact pieces 33 that are made of an electrically conductive material and are positioned in spaced apart positions all along the core 31, each of the pieces 33 defining one segment on which only a short number of the anodes and cathodes are connected. The segments defined by the pieces 33 are separated from each other by grooves 27 that extend down to the core 31.

Figure 10:
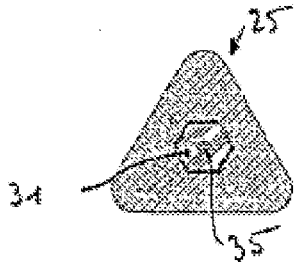
FIG. 10 is a cross-sectional view taken along lines X-X, the contact bar shown in FIG. 7.
Figure 11:
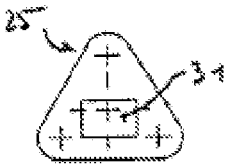
FIG. 11 is a cross-sectional view similar to FIG. 10, but illustrating a core of a different structure.
Figure 12:
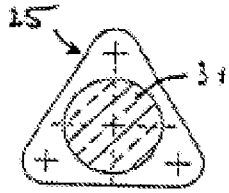
FIG. 12 is a cross-sectional view similar to FIG. 10 but illustrating a core of another different structure.

In practice, the core 31 may be of circular cross-section as shown in FIG. 12. However, it could be of non-circular cross-section, like square, or rectangular as shown in FIG. 11, hexagonal as shown in FIG. 10, and the like.

Preferably, the core 31 consists of a pultruded bar like those used to reinforce the above mentioned capping board 1, which bar is obtained by pultrusion of fibers.

Preferably also, the core 31 may comprise a metal rod 35 completely embedded therein, this metal rod extending all over the length of the core. (see FIG. 8 to 10). Such a metal rod 35 prevents the contact bar 25 from breaking or being cut.

As may be seen in the accompanying drawings (see in particular FIGS. 5 and 6), each of the contact pieces 33 is sized to allow connection of only two anodes 3 located in one of the adjacent cell to only two cathodes 5 located in the other adjacent cell. As aforesaid, due to such a division of the contact bar 25 into segments, any short circuit that occurs by accident is no more "transferred" to all the electrodes of the cells. It is actually transmitted only to the electrode in contact with the segment to which is connected the electrode that is at the origin of the trouble. Such not only reduces but avoids the risk of transmission of a short circuit to all electrodes, as it may occur with the existing contact bars.

Even though such has not been illustrated, each contact piece 33 could be sized to allow connection of two, three, four or more adjacent anodes located in one of the adjacent cells, to two, three, four or more adjacent cathodes located in another one of adjacent cells, instead of connecting only one of them only to each other. In all cases, the only requirement is that all the electrodes of one cell be not in direct contact with no gap or resistance in between, with all the electrodes of the adjacent cell.

Of course, other modification could be made to the contact bar disclosed hereinabove without departing from the scope of the invention as broadly disclosed in the summary of the invention and the appended claims.

The invention claimed is:

1. A contact bar for use on a capping board of a given length to electrically connect a plurality of anodes and cathodes extending in spaced apart alternate positions in adjacent electrolytic cells all along said capping board, said contact bar extending over the length of the capping board and being of a given average cross-section, said contact bar comprising:

a central core that is made of an insulating material and extends all over the length of said contact bar, and a plurality of contact pieces that are made of an electrically conductive material and are positioned in spaced apart positions all along said core, each of said pieces defining a segment on which only a short number of said anodes and cathodes are connected.

2. The contact bar of claim 1, wherein said core is of circular cross-section.

3. The contact bar of claim 1, wherein said core is of non-circular cross-section.

4. The contact bar of claim 3, wherein said contact bar is of triangular cross-section.

5. The contact bar of claim 1, wherein said core consists of a pultruded rod obtained by pultrusion of fibers.

6. The contact bar of claim 1, wherein said core comprises a metal rod completely embedded therein, said metal rod extending all over the length of said core.

7. The contact bar of claim 1, wherein each segment is sized to allow connection of two adjacent anodes located in one of said adjacent cells to two adjacent cathodes located in another one of said adjacent cells.

8. The contact bar of claim 1, wherein each of said segments is sized to allow connection of three adjacent anodes located in one of said adjacent cells to three adjacent cathodes located in another one of said adjacent cells.

9. The contact bar of claim 1, wherein each of said segments is sized to allow connection of four adjacent anodes located in one of said adjacent cells to four adjacent cathodes located in another one of said adjacent cells.

* * * * *